United States Patent [19]

Ikegawa et al.

[11] 4,417,863

[45] Nov. 29, 1983

[54] SCROLL MEMBER ASSEMBLY OF SCROLL-TYPE FLUID MACHINE

[75] Inventors: Masato Ikegawa; Kenji Tojo; Masao Shiibayashi, all of Shimoinayoshi, Japan

[73] Assignee: Hitachi, Ltd., Tokyo, Japan

[21] Appl. No.: 225,741

[22] Filed: Jan. 16, 1981

[51] Int. Cl.[3] ..... F01C 1/02

[52] U.S. Cl. ..... 418/55

[58] Field of Search ..... 418/55, 59

[56] References Cited

U.S. PATENT DOCUMENTS

| | | | |
|---|---|---|---|
| 2,841,089 | 7/1958 | Jones | 418/55 |
| 3,473,728 | 10/1969 | Vulliez | 418/59 |
| 4,157,234 | 6/1979 | Weaver et al. | 418/55 |

*Primary Examiner*—John J. Vrablik

*Attorney, Agent, or Firm*—Antonelli, Terry & Wands

[57] ABSTRACT

A scroll member assembly of a scroll-type fluid machine, having a stationary scroll member and an orbiting scroll member each including an end plate and a wrap protruding upright from the end plate. The scrolling members are assembled together with the wraps fitting each other, in such a manner that the orbiting scroll member makes an oribitary motion relatively to the stationary scrolling member but does not rotate around its own axis. The wrap of the stationary scroll member has a scrolling angle which is greater than that of the wrap of orbiting scroll member by an angle not greater than 180°.

14 Claims, 6 Drawing Figures

SCROLL MEMBER ASSEMBLY OF SCROLL-TYPE FLUID MACHINE

BACKGROUND OF THE INVENTION

1. Field of the Invention

The present invention relates to a scroll member assembly of a scroll-type fluid machine which is broadly used as compressors for air conditioning system, refrigeration chamber, refrigeration cycle and gas boosting system, as well as an expander for generating power through an expansion of a fluid.

2. Description of the Prior Art

The construction of scroll-type fluid machine, widely used as compressors and expanders, is well known to those skilled in the art.

This scroll type fluid machine has a pair of scroll members, each having an end plate and a wrap protruding therefrom, combined in such a manner that two wraps mate each other. One of the scroll members makes an orbiting motion relatively to the other but does not make rotation around its own axis. At the center of the end plate, provided is a high-pressure port which acts as a discharge port for discharging the high-pressure gas and an inlet port for a pressurized working fluid, respectively, when the fluid machine is used as a compressor and an expander, while a low-pressure port is formed at the peripheral part of the end plate.

Usually, the wraps of both scroll members have an equal shape, i.e. an equal scroll angle, and the closed spaces defined between two scroll members are in symmetry with respect to a point. Also, these spaces in the state of lowest pressure are formed at different distances from the low-pressure port. Therefore, the space remote from the low-pressure port in the state of lowest pressure is communicated with the low-pressure port to reduce the flow resistance encountered by the flow of gas and a suitable countermeasure is taken to avoid excessive heating of the gas by the wall defining the passage.

In order to minimize the flow resistance, the above-mentioned passage preferably has at large cross-sectional area as possible. The large cross-sectional area requires a correspondingly large diameter of the scroll members, and cause excessive heating of the gas in the state of lowest pressure.

Thus, the minimization of flow resistance and the reduction of diameter of the scroll members are incompatible with each other. It is quite difficult to simultaneously achieve both of these incompatible requisites, and no effective measure has been proposed up to now to meet this demand.

SUMMARY OF THE INVENTION

It is, therefore, an object of the invention to provide an improved scroll member assembly for scroll-type fluid machine, which can permit the diameter of the scroll member to be reduced per unit volume of the gas handled by the machine.

It is another object of the invention to provide a scroll member assembly for scroll-type fluid machine, capable of minimizing the heating of the gas by the scroll member.

It is still another object of the invention to provide a scroll member assembly for scroll-type fluid machine, capable of minimizing the flow resistance encountered by the gas flowing between the low-pressure port and the closed space.

It is a further object of the invention to provide a scroll member assembly for scroll-type fluid machine, which can be formed easily.

It is a still further object of the invention to provide a scroll member assembly for scroll-type fluid machine, which facilitates the mechanical processing of the wrap.

It is a still further object of the invention to provide a scroll member assembly for scroll-type fluid machine, which can reduce the eccentric weight of orbiting scroll member.

It is a still further object of the invention to provide a scroll member assembly for scroll-type fluid machine, which permits a smooth shift of closest or contact region, i.e. the sealing line, between the wraps of two scroll members.

It is a still further object of the invention to provide a scroll member assembly for scroll-type fluid machine suitable for use in a closed cycle.

To these ends, according to the invention, there is provided a scroll member assembly in which the wrap of the stationary scroll member has a scrolling angle greater than that of the wrap of orbiting scroll member by an angle which is not greater than 180.

DESCRIPTION OF THE PREFERRED EMBODIMENTS

Figure 1A:
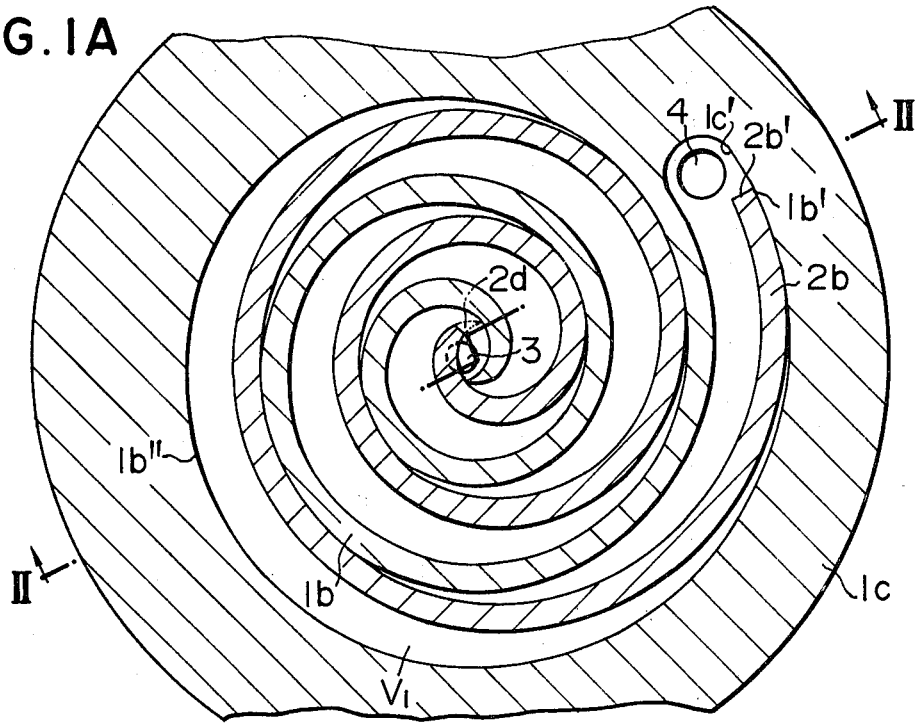
FIG. 1A is a sectional view of a scroll assembly at a plane perpendicular to the axis, taken along the line I—I of FIG. 2.
Figure 1B:
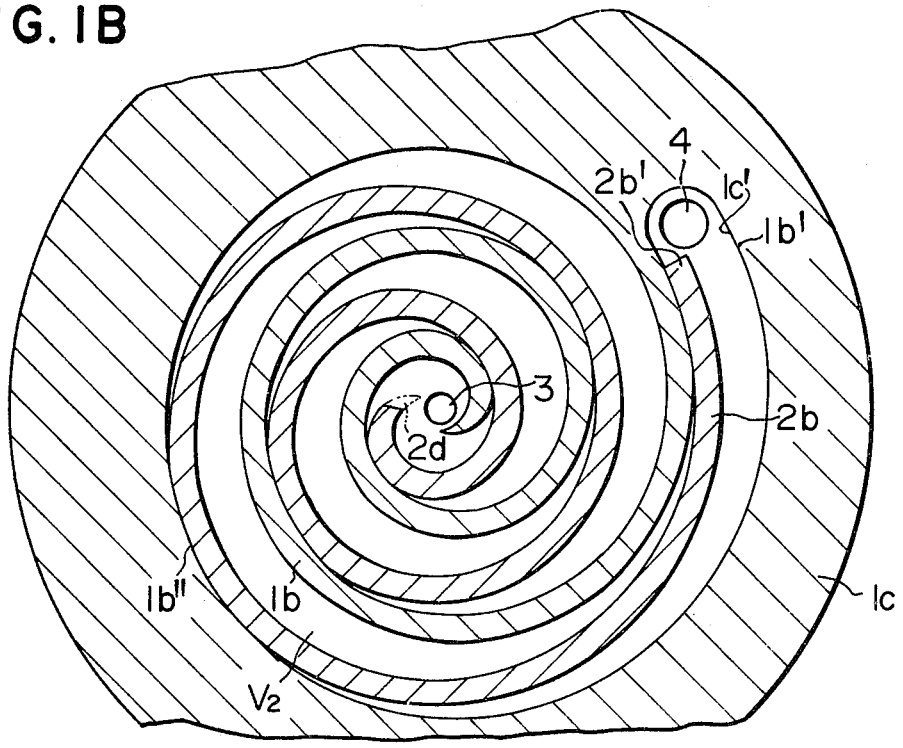
FIG. 1B is a sectional view similar to FIG. 1A but wherein orbiting scroll member is in a position orbited by 180° from the position shown in FIG. 1A.
Figure 2:
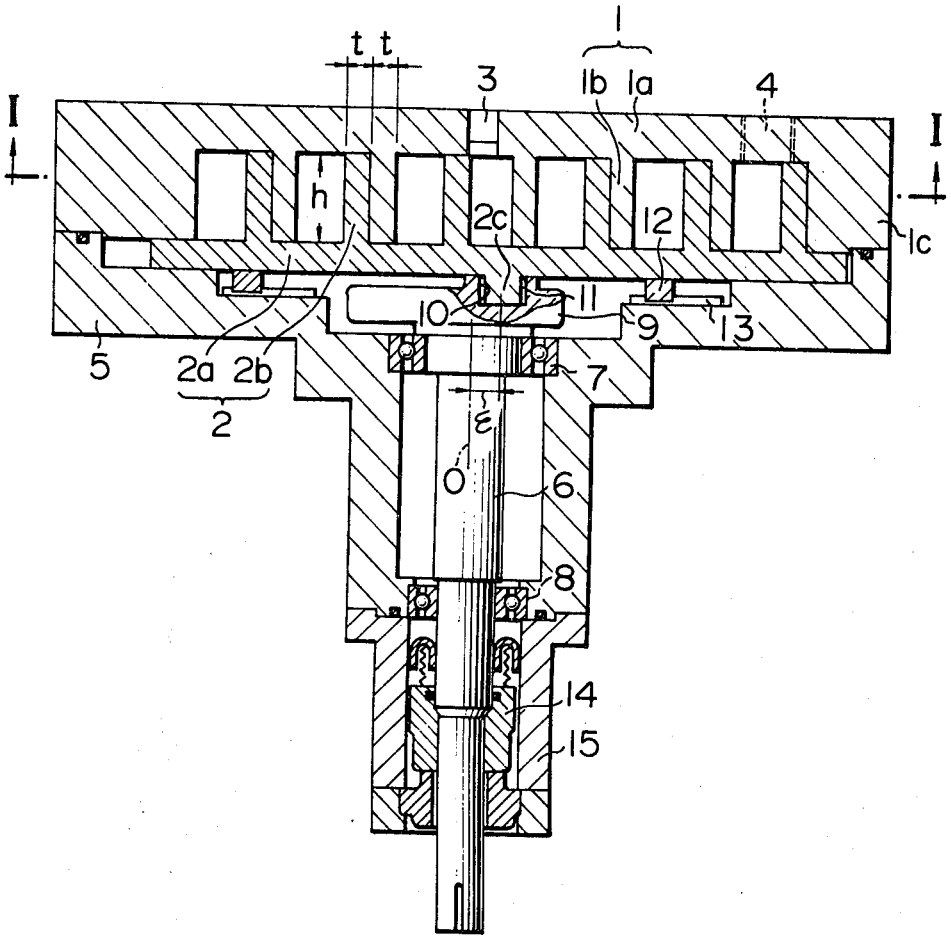
FIG. 2 is a sectional view taken along the line II—II of FIG. 1A.

Referring to FIGS. 1A, 1B and 2, a stationary scroll member 1 has an end plate 1*a*, a spiral or scrolling wrap protruding upright from the end plate 1*a* and a tubular wall portion 1*c* formed around the wrap 1*b* and having the same height as the wrap 1*b*, the inner peripheral surface of the peripheral wall portion 1*c* constituting an extension of the wrap 1*b*. A high-pressure port 3 and a lowpressure port 4 are formed at the center portion of the scroll member 1 and the outside of the end of scrolling of the wrap 1*b*, respectively.

An orbiting scroll member 2 is constituted by an end plate 2*a*, a scrolling wrap 2*b* protruding upright from the end plate 2*a* and a scroll pin 2*c* attached to the side of the end plate 2*a* opposite to the wrap 2*b*.

The wrap 1*b* of the stationary scroll member 1 and the wrap 2*b* of the orbiting scroll member 2 have an equal height h and thickness t. The wrap 1*b* of the stationary scroll member 1 has a scrolling angle which is about 180° greater than the scrolling angle of the wrap 2*b* of the orbiting scroll member 1, so that the scrolling end 1*b*′ of the wrap 1*b* substantially conforms with the scrolling end 2*b*′ of the wrap 2*b*. This can be achieved by extending the scrolling curve over 180° from the scrolling end 1*b*″ of the wrap 1*b* of conventional scroll member 1 to the illustrated scrolling end 1*b*′. The extended curve between the points 1*b*″ and 1*b*′ is constituted by the same kind of curve as the other portion of the scroll. For instance, when the wraps 1*b* and 2*b* are formed along an involute curve of circle as in the illustrated embodiment, the inner surface of the wrap 1*b* follows an involute curve having a base circle over the entire portion thereof from the beginning to the end 1*b*′ of the wrap 1*b*.

Wherein, a portion 1*c*′ is further extended from the end 1*b*′ of the wrap 1*b* for facilitating the disposition of the low-pressure port 4. Although any curve may selectively used at this portion 1*c*′, to make the machining thereof easy, it is preferable to use the same curve as that of the wrap 1*b*.

A frame 5 is attached to the peripheral wall portion 1*c* of the stationary scroll member 1 by means of a plurality of bolts.

A crank shaft 6 is supported by the frame 5 through a pair of bearings 7, 8 provided on the latter. The crank shaft 6 has a balance weight 9 formed unitarily therewith. This balance weight 9 may be formed separately from the crank shaft 6.

The crank shaft 6 has a head in which formed is a boss hole 10 which is offset by a distance $\epsilon$ from the axis 0 of the crank shaft 6 and adapted to receive the scroll pin 2*c*. A needle bearing 11 is disposed between the boss hole 10 and the scroll pin 2*c*.

A rotation prevention member 12 is disposed between the back side of the end plate 2*a* of the orbiting scroll member 2 and the frame 5. The rotation prevention member 12 has a ring-like form and is provided with a linear grooves (not shown) at its side confronting the end plate 2*a*, as well as at the side confronting the frame 5. The groove formed in the surface confronting the frame 5 extends at a right angle to the groove formed in the surface confronting the end plate 2*a*, and is adapted to receive a key 13 fixed to the frame 5.

A conventional mechanical seal 14 is provided on the portion of the crank shaft 6 extending out of the frame 5, and is housed by a seal housing 15.

In operation, as the crank shaft 6 is rotated clockwise as viewed in FIG. 1 by a prime mover (not shown), the orbiting scroll member 2 makes a clockwise orbiting motion relative to the stationary scroll member 1, without making apparent rotation around its own axis. Consequently, the closed spaces $V_1$, $V_2$ shown in FIGS. 1A, 1B formed between the scroll members 1 and 2 are rotated clockwise while decreasing their volumes gradually, so that the fluid taken into the fluid machine through the port 4 is compressed and discharged through the port 3.

To the contrary, as the orbiting scroll member 2 rotates counter-clockwise, the closed spaces $V_1$, $V_2$ gradually increase their volumes while rotating in the counter-clockwise direction, so that the gas of high pressure and temperature is expanded and discharged through the discharge port 4, while imparting a torque to the crank shaft 6.

In the described embodiment, since the scrolling angle of the wrap 1*b* of the stationary scroll member 1 has a scroll angle 180° greater than that of the wrap 2*b* of the orbiting scroll member 2, the maximum volume of the closed space $V_1$ is correspondingly increased to increase the theoretical suction volume.

Also, the surface of the wrap 1*b* between the points 1*b*″ and 1*b*′ is disposed at the inner side of that in the conventional scroll member in which the passage is formed.

Thus, the increase of the theoretical suction volume permits a reduction of the diameter (size) of the scroll member 1 per unit volume. In addition, the extension of the scroll curve between the points 1*b*″ and 1*b*′ is positioned radially inwardly as compared with the conventional scroll member, to permit a further reduction of the diameter. For these reasons, it is possible to remarkably reduce the diameter of the scroll member 1.

In the case where the fluid machine is used as a compressor, the gas can be sucked under almost equal condition by both of the closed spaces $V_1$ and $V_2$ formed at the outside and inside of the wrap 2*b* when the suction is completed, provided that the port 4 is disposed at a close proximity of the scrolling end 2*b*′ of the orbiting scroll member 2.

At the moment of completion of the suction, the closed spaces $V_1$ and $V_2$ formed at the outside and inside of the wrap 2*b* have different volumes. This means that different discharge pressure are established when these closed spaces are brought to the position immediately before the discharge, i.e. immediately before these closed spaces $V_1$, $V_2$ are brought into communication with the discharge port 3.

Figure 3:
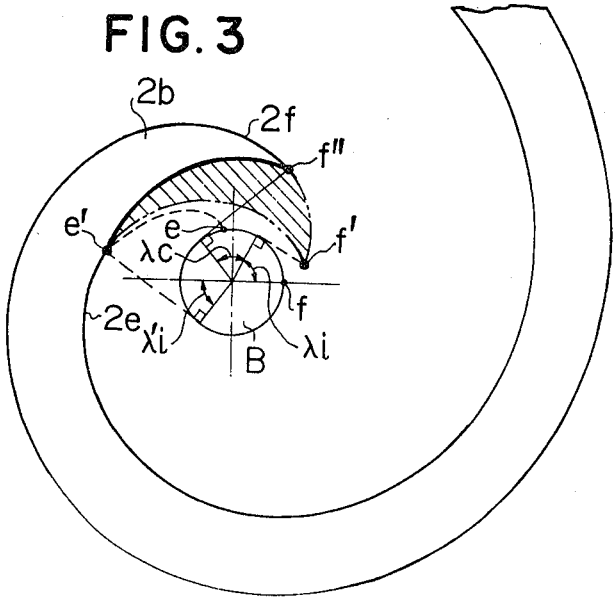
FIG. 3 is a detailed illustration of starting portion of scrolling of the wrap

If such a difference of the discharge pressure has to be avoided, the starting end portion 2*d* of scroll of the wrap 2*b* of the orbiting scroll member 2 is cut-away as illustrated by broken line to make one of the closed spaces communicate with the discharge port 3 at an earlier timing to equalize the discharge pressures of both closed spaces. This arrangement will be explained in more detail with specific reference to FIG. 3.

The wrap 2*b* is formed by an inner involute 2*e* and outer involute 2*f* which start theoretically at points e and f, respectively. However, actually, the inner involute 2*e* and the outer involute 2*f* start at points e′ and f′, respectively, to avoid mutual interference between the wraps 1*b* and 2*b*, and to facilitate the machining.

The outer involute 2*f* has an angle $\lambda i$ (rad) up to the scrolling starting point f. This angle is generally referred to as scroll starting angle. And the inner involute 2*e* has the same scroll starting angle $\lambda' i$ as that of the outer involute of the stationary scroll wrap 1*b*.

On the other hand, since the closed space $V_1$, having an increasing volume, is defined at the outside of the wrap 2 of the orbiting scroll member 2, only the outer involute 2*f* of the wrap 2 is partially cut and removed.

The angle $\lambda c$ of cutting is in inverse proportion to the volume ratio $V_r$, i.e. to the ratio of volume of sucked gas to the volume of discharged gas.

In the case of an expander, the volume ratio Vr is the ratio of volume of outlet gas to the volume of inlet gas.

Namely, the angle $\lambda c$ is given by the following equation:

$$\lambda c = \alpha / Vr$$

where, $\alpha$ represents the angle over which the wrap 1*b* of the stationary scroll member 1 is extended. Thus, in FIG. 3, the hatched area within the curves interconnecting the points e′, f′ and f″ is cut and removed. Any desired curve may be used to connect the starting point e′ of the inner involute 2*e* and the point f″ of cutting of the outer involute 2*f* of the wrap 2*b*.

The basic circle is represented by a symbol B.

It is also possible to cut and remove a part of only the inner involute of the stationary scroll member 1, instead of the cutting of the wrap 2b of the orbiting scroll member 2. The above-described machining of the wrap 2b or the wrap 1b is unnecessary if no substantial inconvenience is caused by the unbalance of the discharge pressure between the two closed spaces.

Figure 4A:
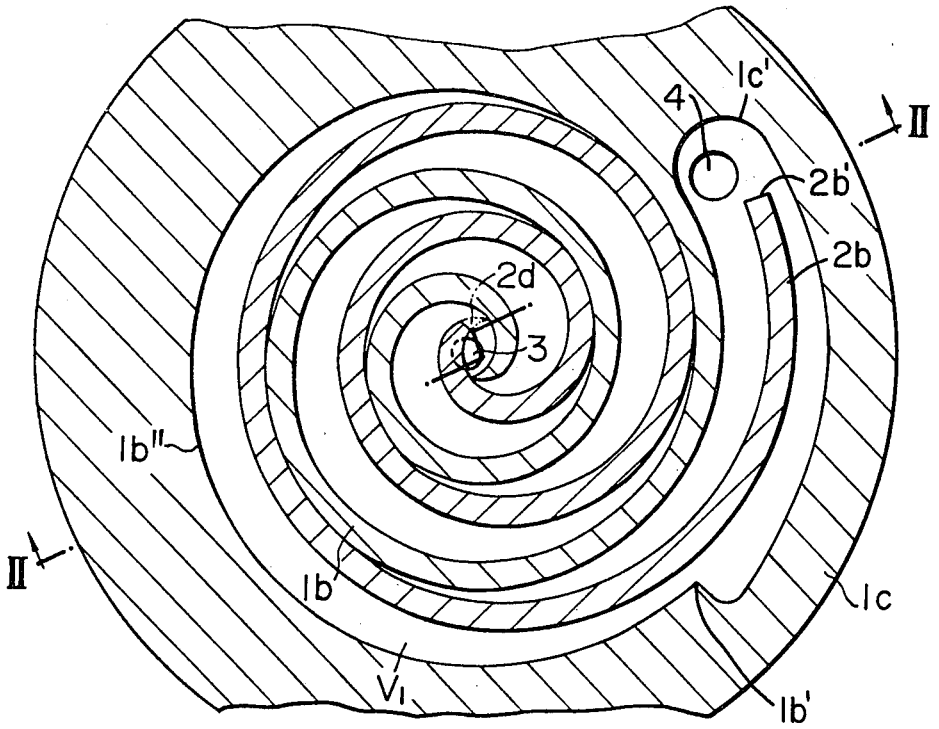
FIG. 4A is a cross-sectional view of another scroll assembly taken along a plane perpendicular to the axis of rotation.
Figure 4B:
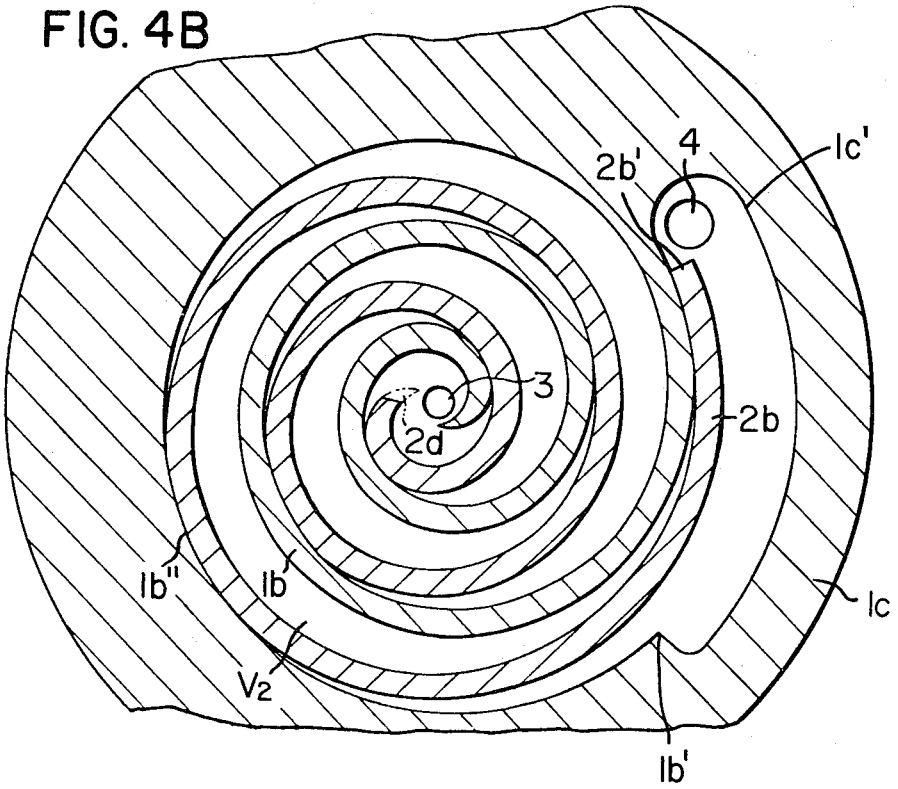
FIG. 4B is a cross-sectional view similar to FIG. 4A with the orbiting scroll member in a position orbited by 180° from the position in FIG. 4A.

In the described embodiment, the wrap 1b of the stationary scroll member 1 is extended over an angle of 180°. The angle of extension, however, can be selected as desired within the range not greater than 180° as shown in FIGS. 4A and 4B.

It is also to be pointed out that the invention covers such a modification that the wrap 2b of the orbiting scroll member 2 is shortened within an angular range not greater than 180° or that the extension of the wrap 1b of the stationary scroll member 1 and the shortening of the wrap 2b of the orbiting scroll member 2 are simultaneously adopted.

As has been described, according to the invention, the scrolling angle of the wrap 1b of stationary scroll member 1 is selected to be greater than that of the wrap 2b of orbiting scroll member 2 within an angular range of not greater than 180°. Therefore, the unnecessary space outside the scroll members 1,2 is eliminated and the theoretical suction volume is increased to permit the size of the scroll member per unit volume and, hence, the overall size of the scroll-type fluid machine to be reduced remarkably.

What is claimed is:

1. A scroll-type fluid machine comprising an inlet port means, a pair of scroll members, each of said scroll members including an end plate and a wrap protruding upright from said end plate, said scroll members being assembled together with said wraps fitting each other so as to define at least a pair of closed spaces therebetween, means for mounting one of said scroll members so as to enable an orbiting motion relative to the other scroll member, the wrap of one of the scroll members has a scrolling angle which is greater than the scrolling angle of the wrap of the other of the scroll members, and wherein a starting end portion of at least one of the wraps is cut away from the theoretical starting point of said one wrap, which theoretical starting point would sealingly engage the other wrap at some time during the orbiting motion so as to enable one of said closed spaces to communicate with a discharge port of the fluid machine at an earlier point in time than the other of said closed spaces thereby substantially equalizing discharge pressures of both of said closed spaces.

2. A scroll-type fluid machine as claimed in claim 1, wherein the difference of the scrolling angle between the wrap of said one of said scroll members and said other of the scroll members is less than 180°.

3. A scroll-type fluid machine as claimed in claim 1, wherein the difference of the scrolling angle between the wrap of said one of said scroll members and said other of said scroll members is equal to 180°.

4. A scroll member assembly of a scroll-type fluid machine, having a pair of scroll members each having an end plate and a scrolling wrap protruding upright from said end plate, said scroll members being assembled together with said wraps fitting each other so as to define at least a pair of closed spaces therebetween, one of said scroll members being adapted to make an orbiting motion relative to the other stationary scroll member in such a manner so as not to make an apparent rotation around its own axis, while shifting said pair of closed spaces between a high pressure port and a low pressure port formed in said assembly, the wrap of one of said scroll members has a scrolling angle which is greater than the scrolling angle of the wrap of the other scroll member whereby the greatest volumes of the closed spaces are unequal at any given time, and a scrolling starting end of one of said wraps is cut-away from the theoretical starting point of said one wrap, which theoretical starting point would sealingly engage the other wrap at some time during the orbiting motion in order to enable one of said closed spaces to communicate with the high pressure port of a period of time greater than a time period of communication of the high pressure port with the other of said closed spaces in proportion to the difference between the scrolling angles of the wraps of said scroll members, whereby the pressures of said pair of closed spaces at a moment that both spaces are brought into communication with the high pressure port are made substantially equal to each other.

5. A scroll member assembly as claimed in claim 4, wherein an outer curve of the orbiting scroll member is cut-away in order to make the time period of communication of one of the closed spaces with the high pressure port greater than the time period of communication of the other closed space.

6. A scroll member assembly as claimed in one of claims 4 or 5, wherein an angle λc of cutting is selected to meet the following relationship:

$$\lambda c = \alpha / Vr,$$

where:

Vr = a volume ratio, $\alpha$ = a difference of the scrolling angle between the wrap of said one of said scroll members and the wrap of said other of said scroll members.

7. A scroll member assembly as claimed in one of claims 4 or 5, wherein the low-pressure port is formed in the close proximity of scrolling ends of both scroll members.

8. A scroll member assembly as claimed in one of claims 4 or 5, wherein the wrap of said stationary scroll member has the greater scrolling angle, a portion of said wrap of said stationary scroll member extending beyond the scrolling end of said orbiting scrolling member follows the same curve as the other portion of the same.

9. A scroll member assembly as claimed in one of claims 4, or 5, wherein said wrap of each scroll member is formed to follow an involute curve.

10. A scroll member assembly as claimed in claim 7, wherein said wrap of each scroll member is formed to follow an involute curve.

11. A scroll member assembly as claimed in claim 7 wherein a portion of an inner wall of a peripheral wall portion of the stationary scroll member in proximity of said low-pressure port is formed as an extension of the end of the wrap of the stationary scroll member and of the same curve as that of said wrap.

12. A scroll member assembly as claimed in claim 8, wherein a portion of an inner wall of a peripheral wall portion of the stationary scroll member in proximity of said low-pressure port is formed as an extension of the end of the wrap of the stationary scroll member and of the same curve as that of said wrap.

13. A scroll member assembly as claimed in claim 9, wherein a portion of an inner wall of a peripheral wall portion of the stationary scroll member in proximity of said low-pressure port is formed as an extension of the end of the wrap of stationary scroll member and of the same curve as that of said wrap.

14. A scroll assembly as claimed in claim 10, wherein a portion of an inner wall of a peripheral wall portion of the stationary scroll member in proximity of said low-pressure port is formed as an extension of the end of the wrap of the stationary scroll member and of the same curve as that of said wrap.

* * * * *